US011640746B2

(12) United States Patent
Escalante

(10) Patent No.: US 11,640,746 B2
(45) **Date of Patent: *May 2, 2023**

(54) COMPUTER-IMPLEMENTED METHOD AND SYSTEM OF PROVIDING GAMING SERVICES

(71) Applicant: VGW HOLDINGS LIMITED, Perth (AU)

(72) Inventor: Laurence Escalante, Como (AU)

(73) Assignee: VGW HOLDINGS LIMITED, Perth (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/458,035

(22) Filed: Aug. 26, 2021

(65) Prior Publication Data

US 2022/0044525 A1 Feb. 10, 2022

Related U.S. Application Data

(63) Continuation of application No. 16/748,563, filed on Jan. 21, 2020, now Pat. No. 11,132,865, which is a (Continued)

(51) Int. Cl.
*G07F 17/32* (2006.01)

(52) U.S. Cl.
CPC ..... *G07F 17/3255* (2013.01); *G07F 17/32* (2013.01); *G07F 17/329* (2013.01); (Continued)

(58) Field of Classification Search
None
See application file for complete search history.

(56) References Cited

U.S. PATENT DOCUMENTS 7,316,614 B2 1/2008 Dietz et al.
7,878,900 B2 2/2011 Lind et al.
(Continued)

FOREIGN PATENT DOCUMENTS

CN 104395940 A 3/2015
RU 2359330 C9 11/2009
(Continued)

OTHER PUBLICATIONS

Russian Office Action dated May 20, 2022, for RU Application No. 2020129559, with English translation, 17 pages.
(Continued)

*Primary Examiner* — Jason T Yen
(74) *Attorney, Agent, or Firm* — Morrison & Foerster LLP

(57) ABSTRACT

A method of providing gaming services includes allocating to a player, at least one non-monetary sweepstakes entry for use in a sweepstakes game; providing at least one sweepstakes game, the at least one sweepstakes game which is open for entry to one or more eligible players; allow the player to assign, via a graphical user interface, at least one non-monetary sweepstakes entry to the at least one sweepstakes game; receiving from the player, an indication that the at least one non-monetary sweepstakes entry has been assigned to the at least one sweepstakes game; playing the at least one sweepstakes game; awarding to the player on a successful outcome of the sweepstakes game, an allocation of non-monetary sweepstakes entries and notifying the player, via the graphical user interface, of the allocation of non-monetary sweepstakes entries.

15 Claims, 8 Drawing Sheets

Related U.S. Application Data continuation of application No. 16/138,748, filed on Sep. 21, 2018, now Pat. No. 10,580,256, which is a continuation of application No. 15/780,613, filed as application No. PCT/IB2017/000363 on Mar. 21, 2017, now abandoned.

(60) Provisional application No. 62/311,958, filed on Mar. 23, 2016.

(52) U.S. Cl.
CPC ..... *G07F 17/3218* (2013.01); *G07F 17/3223* (2013.01); *G07F 17/3244* (2013.01); *G07F 17/3248* (2013.01); *G07F 17/3262* (2013.01); *G07F 17/3267* (2013.01)

(56) References Cited

U.S. PATENT DOCUMENTS

| | | | | |
|---|---|---|---|---|
| 8,435,119 | B2 | 5/2013 | Hardy | |
| 8,808,077 | B1 | 8/2014 | Chun | |
| 8,814,664 | B2 | 8/2014 | Amaitis et al. | |
| 8,821,247 | B2 | 9/2014 | Schulzke et al. | |
| 9,595,168 | B2 | 3/2017 | Shankar | |
| 9,824,537 | B1 | 11/2017 | Pascal et al. | |
| 10,242,538 | B2 | 3/2019 | Pierce | |
| 10,366,566 | B1 | 7/2019 | Pascal et al. | |
| 10,403,091 | B2 | 9/2019 | Costello et al. | |
| 10,580,256 | B2 | 3/2020 | Escalante | |
| 11,132,865 | B2 | 9/2021 | Escalante | |
| 2002/0116615 | A1 | 8/2002 | Nguyen | |
| 2003/0105663 | A1 | 6/2003 | Steinman | |
| 2005/0096135 | A1* | 5/2005 | Houchin | G07F 17/32 463/42 |
| 2009/0054134 | A1* | 2/2009 | Jackson | G07F 17/3258 463/25 |
| 2009/0287552 | A1* | 11/2009 | Shepherd | G06Q 30/0207 705/14.1 |
| 2010/0253063 | A1 | 10/2010 | Skogster | |
| 2010/0267438 | A1* | 10/2010 | Williams | G07F 17/3255 463/17 |
| 2011/0092267 | A1* | 4/2011 | Hardy | G07F 17/3255 463/17 |
| 2012/0115563 | A1 | 5/2012 | Kido | |
| 2013/0184072 | A1 | 7/2013 | Foster | |
| 2013/0204682 | A1* | 8/2013 | Stachiw | G06Q 30/02 705/14.14 |
| 2013/0210531 | A1 | 8/2013 | Ivanov | |
| 2014/0351031 | A1* | 11/2014 | Randel | G06Q 30/0212 705/14.14 |
| 2015/0005060 | A1 | 1/2015 | Shankar | |
| 2015/0045112 | A1* | 2/2015 | Donavan | G07F 17/3209 463/25 |
| 2015/0235526 | A1 | 8/2015 | Dicarlo | |
| 2016/0148465 | A1 | 5/2016 | Arnone et al. | |
| 2017/0264681 | A1* | 9/2017 | Apte | H04W 12/08 |
| 2019/0005769 | A1 | 1/2019 | Escalante | |

FOREIGN PATENT DOCUMENTS

| | | | |
|---|---|---|---|
| RU | 2417812 | C1 | 5/2011 |
| WO | 2013086211 | A2 | 6/2013 |

OTHER PUBLICATIONS

Canadian Office Action dated Aug. 31, 2021, for CA Application No. 3,012,736, seven pages.
Canadian Office Action dated Feb. 18, 2021, for CA Application No. 3,012,736, six pages.
Canadian Office Action dated Jul. 6, 2020, for CA Application No. 3,012,736, five pates.
Chinese Office Action dated Jan. 18, 2021, for CN Application No. 201780018645.X, with English translation, 9 pages.
Chinese Office Action dated Jul. 21, 2021, for CN Application No. 201780018645.X, with English translation, 26 pages.
European Office Action dated Apr. 7, 2020, for EP Application No. 17769518.6, six pages.
Examination Report for Standard Patent Application, dated Dec. 11, 2020, for AU Application No. 2017238720, five pages.
Examination Report for Standard Patent Application, dated Jun. 18, 2020, for AU Application No. 2017238720, four pages.
Extended European Search Report dated Jul. 3, 2019, for EP Application No. 17769518.6, nine pages.
Final Office Action dated Aug. 16, 2019, for U.S. Appl. No. 16/138,748, filed Sep. 21, 2018, seventeen pages.
Non-Final Office Action dated Dec. 15, 2020, for U.S. Appl. No. 16/748,563, filed Jan. 21, 2020, six pages.
Non-Final Office Action dated Feb. 13, 2019, for U.S. Appl. No. 15/780,613, filed May 31, 2018, sixteen pages.
Non-Final Office Action dated Feb. 13, 2019, for U.S. Appl. No. 16/138,748, filed Sep. 21, 2018, fifteen pages.
Notice of Allowance (corrected) dated Aug. 26, 2021, for U.S. Appl. No. 16/748,563, filed Jan. 21, 2020, two pages.
Notice of Allowance dated Dec. 20, 2019, for U.S. Appl. No. 16/138,748, filed Sep. 21, 2018, ten pages.
Notice of Allowance dated Jun. 16, 2021, for U.S. Appl. No. 16/748,563, filed Jan. 21, 2020, ten pages.
Russian Notice of Allowance and search report dated Jul. 10, 2020, for RU Application No. 2018133156, with English translation, 23 pages.
Chinese Office Action dated Nov. 18, 2021, for CN Application No. 201780018645.X, with English translation, 14 pages.
Russian Office Action and search report dated Dec. 23, 2021, for RU Application No. 2020129559/28, with English translation, 14 pages.
Canadian Notice of Allowance dated Nov. 3, 2022, for CA Application No. 3,012,736, with English translation, one page.
Russian Office Action dated Jan. 20, 2023, for RU Application No. 2020129559/28, with English translation, 17 pages.

* cited by examiner

COMPUTER-IMPLEMENTED METHOD AND SYSTEM OF PROVIDING GAMING SERVICES

CROSS REFERENCE TO RELATED APPLICATION

This application is a Continuation of U.S. application Ser. No. 16/748,563, filed Jan. 21, 2020, which is a Continuation of U.S. application Ser. No. 16/138,748 (now U.S. Pat. No. 10,580,256), filed Sep. 21, 2018, which is a Continuation of U.S. application Ser. No. 15/780,613, filed May 31, 2018, which is a U.S. National Phase application under 35 U.S.C. § 371 of International Application No. PCT/IB2017/000363, filed Mar. 21, 2017, which claims the benefit of priority to U.S. Provisional Application No. 62/311,958 filed on Mar. 23, 2016, each of which is hereby incorporated by reference in their entirety.

TECHNICAL FIELD

The disclosure generally relates to a computer-implemented method and system of providing gaming services, and more particularly to providing a gaming service that incorporates a sweepstakes game.

BACKGROUND

The persistent state of mechanics that exists within traditional world slot-machines is entirely different from those that exist in the virtual world. Significant technical uncertainty and challenges exist in the creation of persistent state mechanics for virtual in-game developments that take into account certain game elements such as gaming sessions and the elapsed time between players. In addition, various technical and legal challenges must be addressed when considering the award of non-monetary and monetary prizes on virtual gaming platforms.

Sweepstakes are a type of contest where a prize or prizes may be awarded to a winner or winners and, by definition (and law, in most jurisdictions), require that the winner or winners be determined by luck rather than skill. More specifically, a "sweepstakes" is any procedure for distributing anything of value by lot or chance. The main difference between a sweepstakes and a lottery is that the lottery participants have paid or promised to pay value for the chance to win the prize, whereas a sweepstakes model specifically prohibits a requirement to pay value for the chance to win the prize. Similarly, the main differences between a sweepstakes and a contest are that the contest participants must use at least some skill to win the prize and must pay some value to participate in the contest, whereas a sweepstakes may not require an element of skill.

In this specification where a document, act, or item of knowledge is referred to or discussed, this reference or discussion is not an admission that the document, act, or item of knowledge or any combination thereof was at the priority date, publicly available, known to the public, part of the common general knowledge; or known to be relevant to an attempt to solve any problem with which this specification is concerned.

Throughout this specification the word "comprise," or variations such as "comprises" or "comprising," will be understood to imply the inclusion of a stated element, integer, or step, or group of elements, integers, or steps, but not the exclusion of any other element, integer, or step, or group of elements, integers, or steps.

SUMMARY

The present disclosure relates to a computer-implemented method of providing gaming services. The method includes allocating to a player, via a communications network, at least one non-monetary sweepstakes entry for use in a sweepstakes game; providing at least one sweepstakes game having at least one successful outcome, the at least one sweepstakes game being configured to be open for entry to one or more eligible players; providing to the player, via a user device, a graphical user interface being configured to allow the player to assign the at least one non-monetary sweepstakes entry to the at least one sweepstakes game; receiving from the player, via the communications network, an indication that the at least one non-monetary sweepstakes entry has been assigned to the at least one sweepstakes game; playing the at least one sweepstakes game; awarding to the player, if the at least one sweepstakes game results in a successful outcome, an allocation of non-monetary sweepstakes entries based on the successful outcome from the at least one sweepstakes game; and notifying the player, via the graphical user interface, of the allocation of the non-monetary sweepstakes entries.

The present disclosure relates to software that when installed on a mobile communication device may cause the mobile communication device to perform the above-disclosed method. The present disclosure also relates to an Application Programming Interface (API) that when installed on a mobile communication device as part of a gaming application may cause the mobile communication device to perform the above-disclosed method.

The present disclosure also relates to a computer-implemented system of providing gaming services. The system includes a computer server accessible through a communications network, the computer server arranged to receive gaining data through the communications network; a processor, communicatively coupled, to the computer server, to one or more graphical information display devices, and to one or more input receiving devices. The processor is configured to allocate to a player, via the communications network, at least one non-monetary sweepstakes entry for use in a sweepstakes game; provide at least one sweepstakes game having at least one successful outcome, the at least one sweepstakes game being configured to be open for entry to one or more eligible players; provide to the player, via a user device, a graphical user interface being configured to allow the player to assign the at least one non-monetary sweepstakes entry to the at least one sweepstakes game; receive from the player, via the communications network, an indication that the at least one non-monetary sweepstakes entry has been assigned to the at least one sweepstakes game; play the at least one sweepstakes game; award to the player if the at least one sweepstakes game results in a successful outcome, an allocation of non-monetary sweepstakes entries based on the successful outcome from the at least one sweepstakes game; and notify the player, via the graphical user interface, of the allocation of non-monetary sweepstakes entries.

The present disclosure also relates to a method as performed by a gaming application installed on a mobile communication device or computing device. The method includes authenticating the gaming application with a computer server; receiving from the computer server, via the communications network, a first gaming data indicative of at least one non-monetary sweepstakes entry for use in a sweepstakes game; sending to the computer server, via the communications network, a second gaming data indicative of an assignment of the at least one non-monetary sweepstakes entry to the sweepstakes game; and receiving from the computer server, via the communications network, a third gaming data indicative of an allocation of non-monetary sweepstakes entries based on a successful outcome associated with the at least one non-monetary sweepstakes entry assigned to the sweepstakes games.

The present disclosure also relates to software that when installed on a mobile communication device may cause the mobile communication device to perform the above-disclosed method. The present disclosure also relates to an Application Programming Interface (API) that when installed on a mobile communication device as part of a gaming application may cause the mobile communication device to perform the above-disclosed method.

The present disclosure also relates to a non-transient computer-readable medium including instructions for performing a method of providing gaming services. The method includes allocating to a player, via a communications network, at least one non-monetary sweepstakes entry for use in a sweepstakes game; providing at least one sweepstakes game having at least one successful outcome, the at least one sweepstakes game being configured to be open for entry to one or more eligible players; providing to the one or more eligible players, via a user device, a graphical user interface being configured to allow the player to assign the at least one non-monetary sweepstakes entry to the at least one sweepstakes game; receiving from the player, via the communications network, an indication that the at least one non-monetary sweepstakes entry has been assigned to the at least one sweepstakes game; operating the at least one sweepstakes game; awarding to the player, if the at least one sweepstakes game results in a successful outcome, an allocation of non-monetary sweepstakes entries based on the successful outcome from the at least one sweepstakes game; and notifying the player, via the graphical user interface, of the allocation of non-monetary sweepstakes entries.

The present disclosure also relates to a computer server for providing gaming services. The computer server includes a communication port to communicate with one or more user devices; a database to store multiple records of gaming data; and a processor configured to authenticate the one or more user devices with the computer server; send to the one or more user devices, via a communications network, a first gaming data indicative of at least one non-monetary sweepstakes entry for use in a sweepstakes game; receive from the one or more user devices, via the communications network, a second gaming data indicative of an assignment of the at least one non-monetary sweepstakes entry to the sweepstakes game; store in the database the second gaming data received from the one or more user devices; operate the sweepstakes game; and send to the one or more user devices, via the communications network, a third gaming data indicative of an allocation of non-monetary sweepstakes entries based on a successful outcome associated with the at least one non-monetary sweepstakes entry assigned to the sweepstakes games;

BRIEF DESCRIPTION OF THE DRAWINGS

Embodiments of the present invention will now be described with reference to the accompanying drawings. These embodiments are given by way of illustration only and other embodiments of the invention are also possible. Consequently, the particularity of the accompanying drawings is not to be understood as superseding the generality of the preceding description.

DETAILED DESCRIPTION

Representative embodiments of the present invention relate to a computer implemented method and system of providing gaming services. The present disclosure has particular application in relation to virtual casino-style slot games. As a result, it is convenient to describe the present invention with reference to those types of games and, more specifically, virtual casino-type slot games that provide to players the option of a sweepstakes game.

Figure 1:
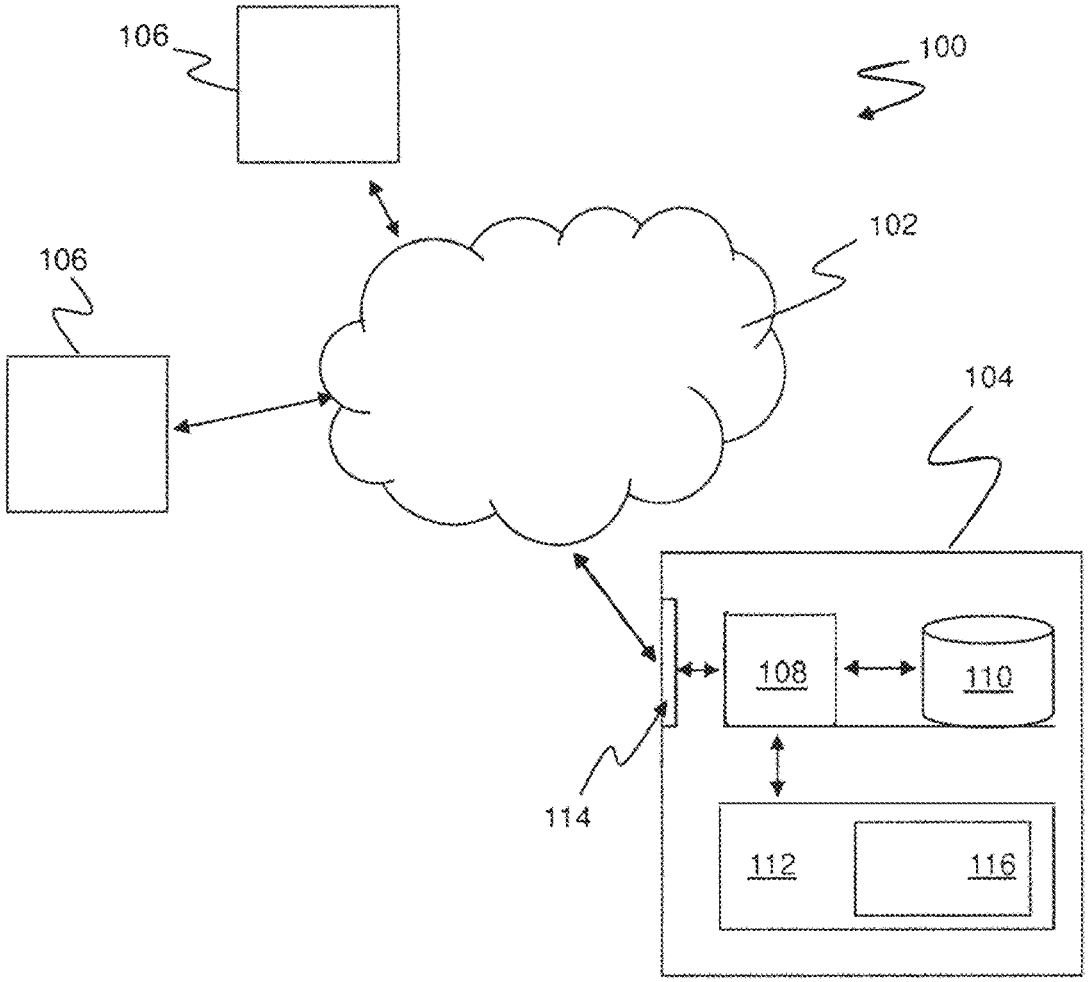
FIG. 1 is a schematic block diagram illustrating a system of providing a gaming service according to a representative embodiment of the present disclosure.

FIG. 1 is a schematic diagram illustrating a system 100 within which embodiments of the present invention may be implemented. The system 100 uses a communications network 102, e.g. the Internet, to facilitate the delivery of various gaming services and, specifically, the delivery of gaming services that incorporate a sweepstakes game.

In the exemplary embodiment 100, a server 104 executes a web server software application for provision of services to user devices 106. Communication between the server 104 and user devices 106 is thus conveniently based upon standard hypertext transfer protocol (HTTP) and/or secure hypertext transfer protocol (HTTPS).

User devices 106 (i.e., 'users' or 'players') may be, for example, fixed devices such as desktop computers and/or, preferably, mobile devices such a smart phones, tablets, notebook computers and so forth. As will be appreciated by persons skilled in the communication arts, various mechanisms and technologies are available to provide access to the Internet 102 from fixed and user devices 106, and all such technologies fall within the scope of the present invention.

The server 104 may generally comprise one or more computers, each of which includes at least one microprocessor 108. The number of computers and processors 108 generally depends upon the required processing capacity of the system, which in turn depends upon the number of concurrent user devices 106 which the system is designed to support. In order to provide a high-degree of scalability, for example when supporting a global user base, the server 104 may utilize cloud-based computing resources, and/or may comprise multiple server sites located in different geographical regions. The use of a cloud computing platform, and/or multiple server sites, enables physical hardware resources to be allocated dynamically in response to service demand. These and other variations, regarding the server computing resources, will be understood to be within the scope of the present invention, although for simplicity the exemplary embodiments described herein employ only a single server 104 with a single microprocessor 108.

The microprocessor 108 may be interfaced to, or otherwise operably associated with, a non-volatile memory/storage device 110. The non-volatile storage 110 may be a hard-disk drive, and/or may include solid-state non-volatile memory such as read-only memory (ROM), flash memory, or the like. The microprocessor 108 is also interfaced to volatile storage 112, such as random access memory (RAM), which contains program instructions and transient data relating to the operation of the server 104.

In a conventional configuration, the storage device 110 maintains known program and data content relevant to the normal operation of the server 104, including operating systems, programs and data, as well as other executable application software necessary to the intended functions of the server 104. In the embodiment shown, the storage device 110 also contains program instructions which, when executed by the processor 108, enable the server 104 to perform operations relating to the implementation of services and facilities embodying the present invention, such as are described in greater detail below with reference to FIGS. 3 to 7. In operation, instructions and data held on the storage device 110 are transferred to volatile memory 112 for execution on demand.

The microprocessor 108 is operably associated with a network interface 114 in a conventional manner. The network interface 114 facilitates access to one or more data communications networks, including the Internet 102, to enable communication between the server 104 and the user devices 106. In use, the volatile storage 112 includes a corresponding body of program instructions 116 configured to perform processing and operations embodying features of the present invention, for example as described below with reference to FIGS. 4 to 7.

For example, the body of program instructions 116 include instructions embodying a web server application. Data stored in the non-volatile 110 and volatile 112 storage comprises web-based code for presentation and/or execution on user devices 106, such as HTML and/or JavaScript code, for facilitating a web-based implementation of a payment transaction service.

Figure 2:
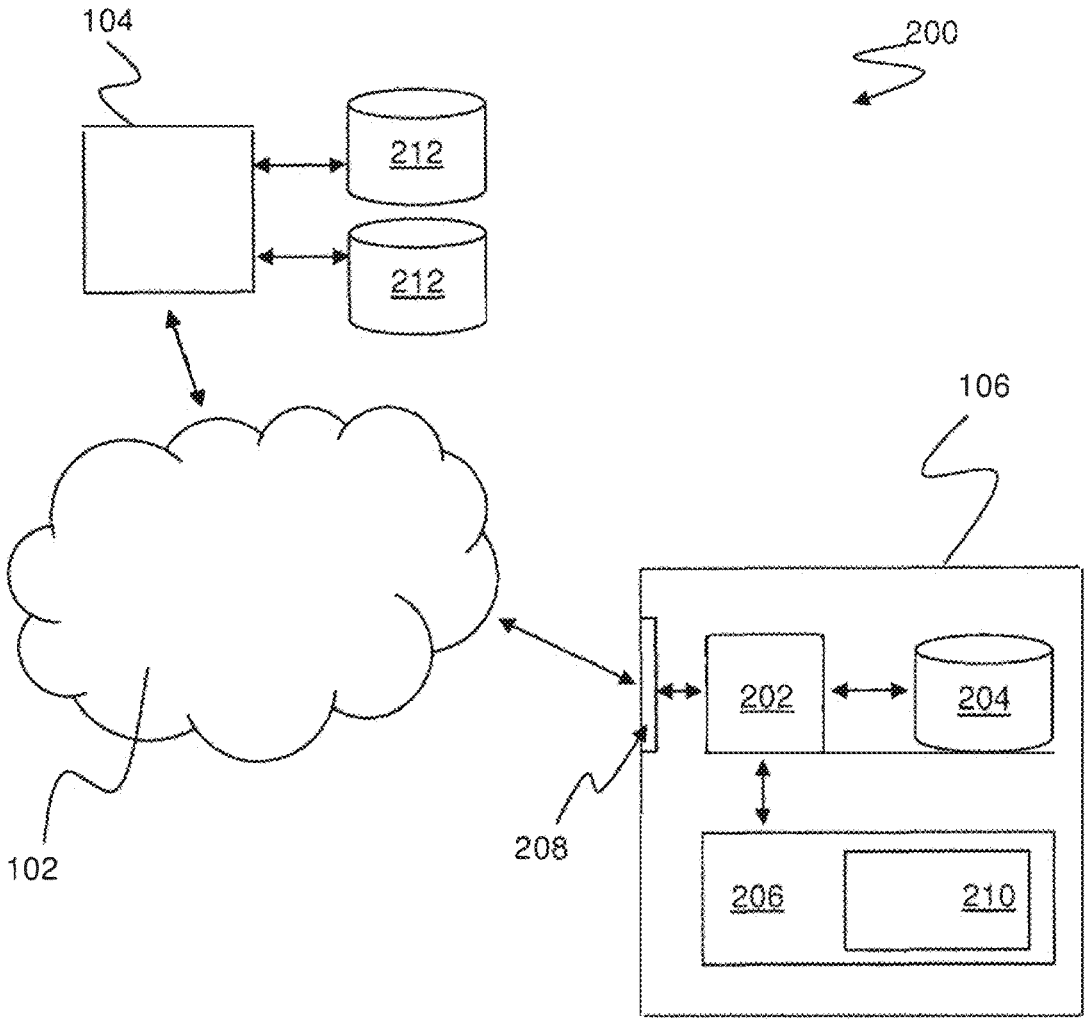
FIG. 2 is a schematic block diagram illustrating a web-based system of providing a gaming service according to an alternative embodiment of the present disclosure.

An alternative implementation 200, again by way of example only, is illustrated in the schematic diagram of FIG. 2. In this alternative embodiment, at least a portion of the executable program code implementing the system is executed within the user devices 106. As shown, each user device is typically a computing device, including at least one microprocessor 202, non-volatile storage 204 and volatile storage 206. Each user device 106 also has a network interface 208, operably associated with the microprocessor 202 in a conventional manner. Accordingly, the user devices 106 are able to conduct computational processing by execution of programs stored locally, in the volatile 206 and non-volatile 204 storage, and/or downloaded via the internet 102 through the network interface 208.

In the embodiment 200 the server 104 may be in communication with one or more databases 212, which may contain records relating to the operation of the gaming service, and additionally may include downloadable software components for execution on the user device 106. For example, a portion of the system may be implemented via program instructions developed in a language such as Java, or some other suitable programming language, which execute on a user device 106 in order to retrieve data via the server 104, and implement some or all of the functionality of the exemplary system of application deployment as described below with reference to FIGS. 3 to 5.

User-side implementations may also include downloadable and executable code in the form of browser plugins, such as ActiveX controls for Windows-based browsers, and/or other applets or apps configured for execution within a browser environment or within a smartphone operating system environment, such as an Apple iOS environment or an Android environment.

Various implementations of embodiments of the invention will be apparent to persons skilled in the art of software engineering, including various combinations of server-side and user-side executable program components.

Figure 5A:
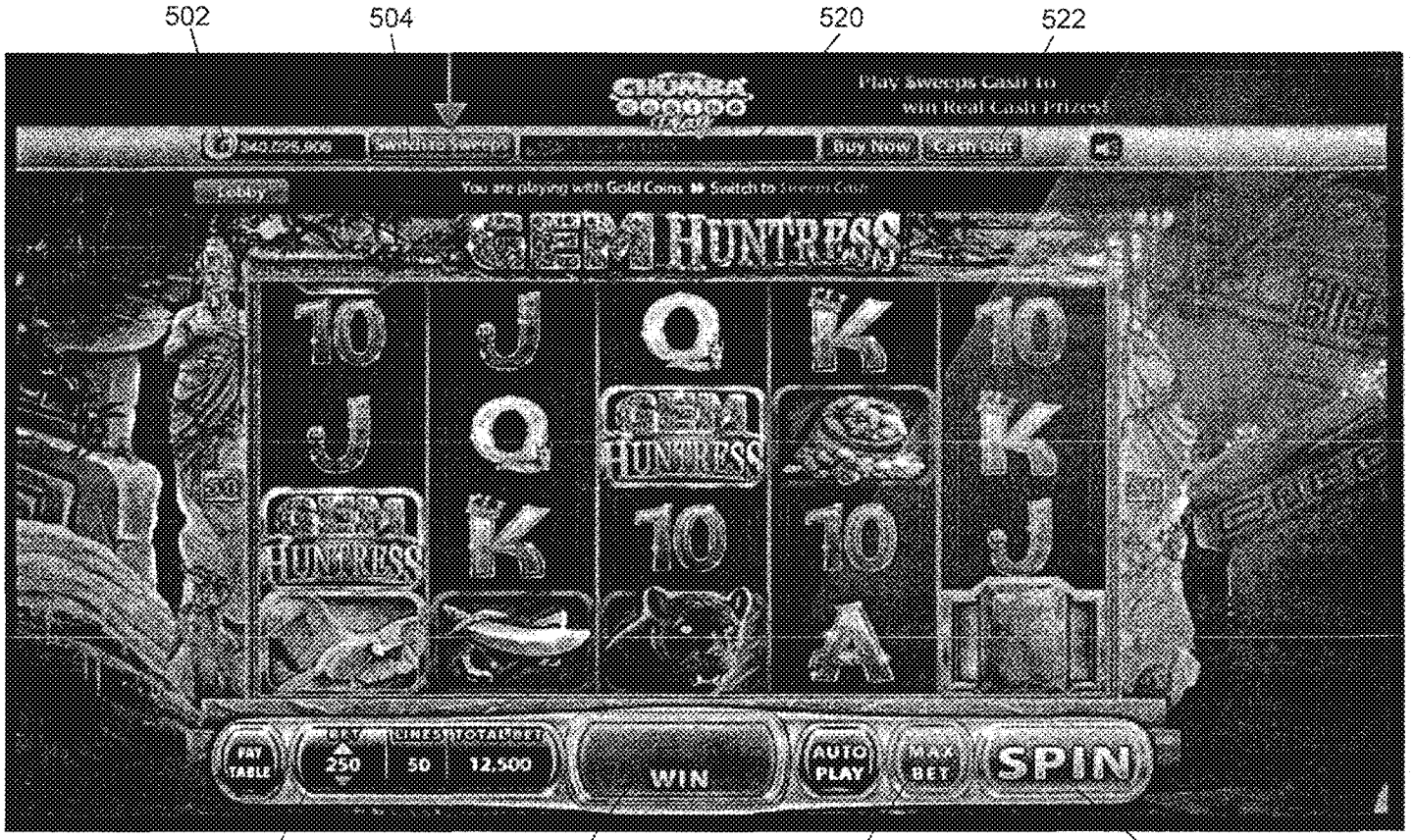
FIG. 5A is a screenshot of a graphical user interface presented to a player according to a representative embodiment of the present invention.
Figure 5B:
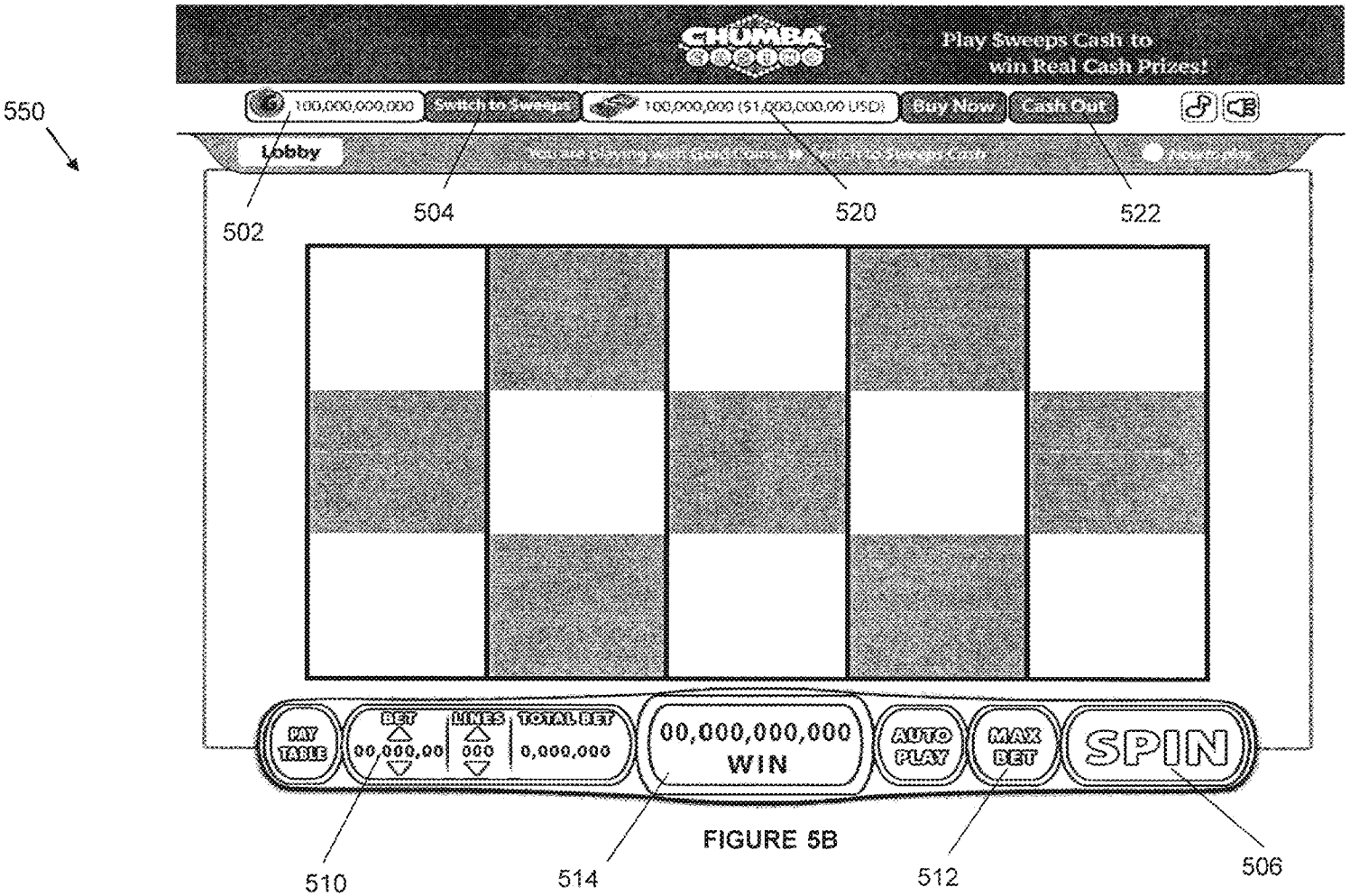
FIG. 5B is a line drawing of a graphical user interface presented to a player according to a representative embodiment of the present invention.

Historically, a slot machine is a common type of casino gambling machine that incorporated three or more reels which spin when a button is pushed. More recently, video slot machines have delivered the same style of game without any mechanical spinning reels, utilizing instead a pseudo random number generator (PRNG) to simulate the rotation of 'virtual reels.' In a representative embodiment of the present invention, the method of providing a gaming service relates to a virtual slot machine (accessible via a computing device on, for example, a social media platform such as Facebook or the like), such as shown in FIGS. 5A and 5B of the drawings, which depict a graphical user interface for a virtual slot machine. However, it should be appreciated that the present invention is also applicable to other games (particularly casino games) such as, for example, poker and blackjack (as discussed in further detail below, and depicted in FIGS. 6 and 7 of the drawings). The method allows for participation in the gaming service on a non-monetary basis, through the use of a virtual gaming currency (referred to herein, by example, as 'Gold Coins'), which can be freely-obtained in limited amounts (and/or subject to time restrictions) or purchased by a player in required amounts. This virtual gaming currency can only be used for participation or 'play' in the gaming service and cannot be exchanged or redeemed for any monetary reward (e.g., legally accepted monetary tender such as, for example, US dollars).

In addition, the method allows for participation in the gaming service through the use of non-monetary entries in a sweepstakes game. The non-monetary sweepstakes entries cannot be purchased, but are allocated to players under certain circumstances. For example, non-monetary sweepstakes entries may be awarded to a player as a bonus offering when purchasing a quantity of virtual gaming currency. Alternatively, or in addition, non-monetary sweepstakes entries may be awarded to players for free as part of mail-ins, giveaways, and other promotions. In any event, the gaming service preferably allows players, during play on a virtual casino game, to select the use of either virtual gaming currency or non-monetary sweepstakes entries. As distinct from virtual gaming currency, non-monetary sweepstakes entries (or any accumulation thereof) can at any stage be 'redeemed' by a player for a monetary reward (e.g., legally accepted monetary tender such as, for example, US dollars).

Figure 3:
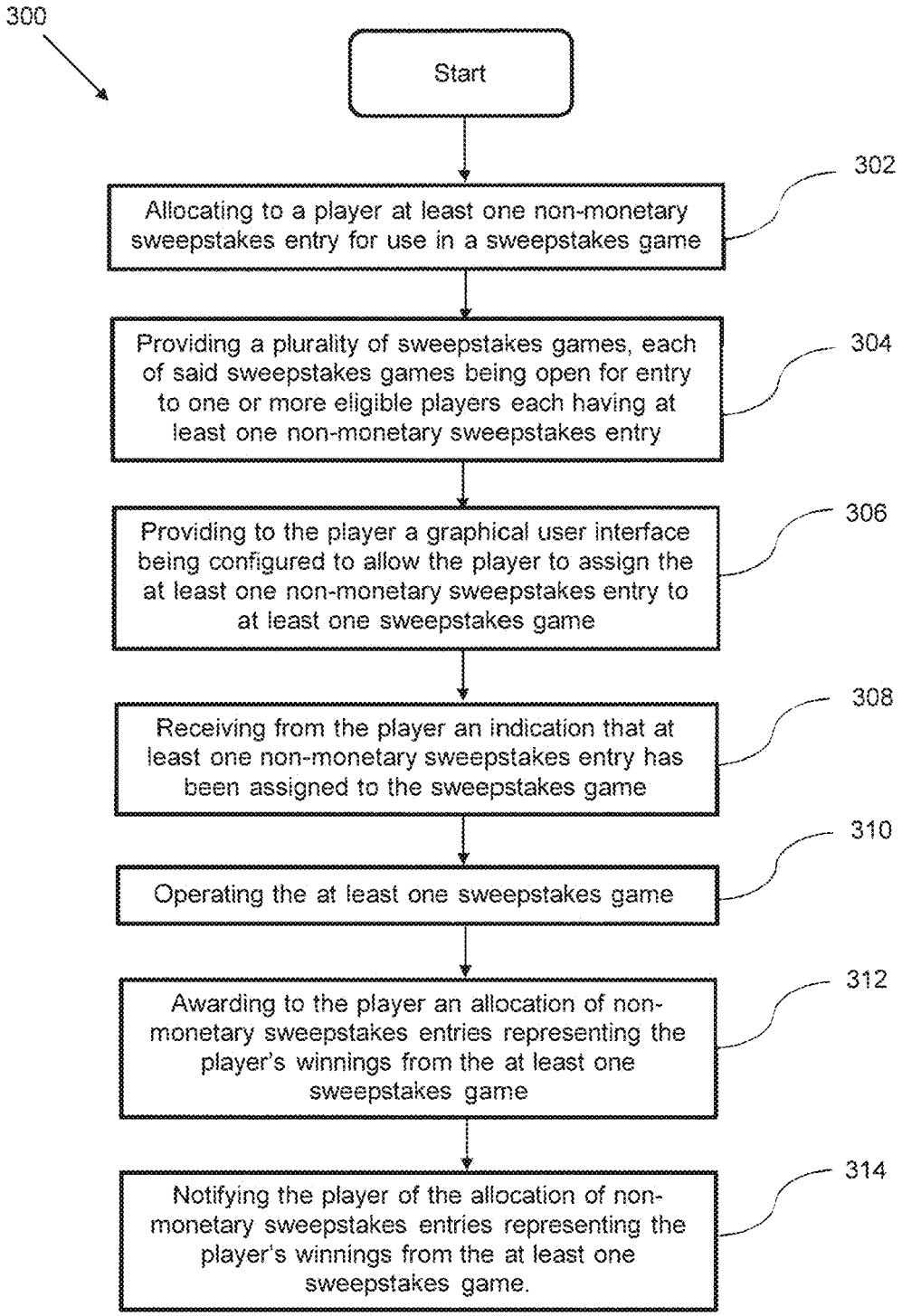
FIG. 3 is a flowchart illustrating an exemplary method of providing a gaming service according to a representative embodiment of the present disclosure.

FIG. 3, for example, depicts a flowchart which illustrates an exemplary method 300 of providing gaming services in accordance with the present invention. A 'user' or 'player' participating in the gaming service will typically have access to a user device 106, such as a mobile communications device (or computing device), including, for example, a smart phone, tablet, notebook computer and so forth. Prior to participation on the gaming service, a 'user' or 'player' may be required to provide certain identifying information (e.g. name, address, contact details), login details (e.g. username and password), and financial information (e.g. credit card details, PayPal account information, or bank account information). At the commencement of the method 300, a player may be required to login to the gaming service in order to play.

At step 302 of exemplary method 300, a player may be allocated at least one non-monetary sweepstakes entry for use in a sweepstakes game. As described above, the non-monetary sweepstakes entry cannot be purchased by a player but may be awarded to a player as a bonus offering when purchasing a quantity of virtual gaming currency. By way of example, virtual gaming currency (referred to herein as 'Gold Coins') can be purchased by a player with a minimum initial purchase of, for example US SI. This may entitle a player to 35,000,000 Gold Coins and 6,000 Sweepstakes Credits (i.e. non-monetary sweepstakes entries) having a redeemable value of US $60, as a first-time purchase bonus. The Gold Coins facilitate gameplay on a virtual gaming currency only basis, are non-cash out enabled, and cannot be redeemed for cash or cash equivalents. An important implication of the Gold Coins not being redeemable for cash is that Gold Coin purchases and gameplay generally does not constitute gambling, even when used to play casino games, and can be offered to players in the majority of countries worldwide.

Sweepstakes Credits are generally awarded on a 1-for-1 basis, with a denomination of US $0.01 for each Sweepstakes Credit (i.e., non-monetary sweepstakes entry). For example, a US $10 purchase of 900,000 Gold Coins (i.e., virtual gaming currency) would also entitle the player to 1,000 Sweepstakes Cash Credits with a redeemable cash value of US $10. As will be described in further detail below, Sweepstakes Credits are redeemable by the player for cash through PayPal (or similar payment transaction platforms), once used to play the casino games to determine their cash prizes. Advantageously, sweepstakes gameplay on the gaming services facilitates a cash prize gaming experience in markets where online gambling may be prohibited.

Alternatively, or in addition, non-monetary sweepstakes entries (e.g., Sweepstakes Credits) may be awarded to players for free as part of mail-ins, giveaways, and other promotions. For example, in exchange for completing a particular mail-in survey or questionnaire, a player (or prospective player) may be awarded an amount of non-monetary sweepstakes entries (e.g., Sweepstakes Credits) for use on the gaming service. In some embodiments, a player (or prospective player) may be required to provide certain identifying information (e.g. name, address, contact details), login details (e.g. username and password), and financial information (e.g. credit card details, PayPal account information, or bank account information) before obtaining access to the gaming service and the awarded non-monetary sweepstakes entries (e.g., Sweepstakes Credits).

Figure 4:
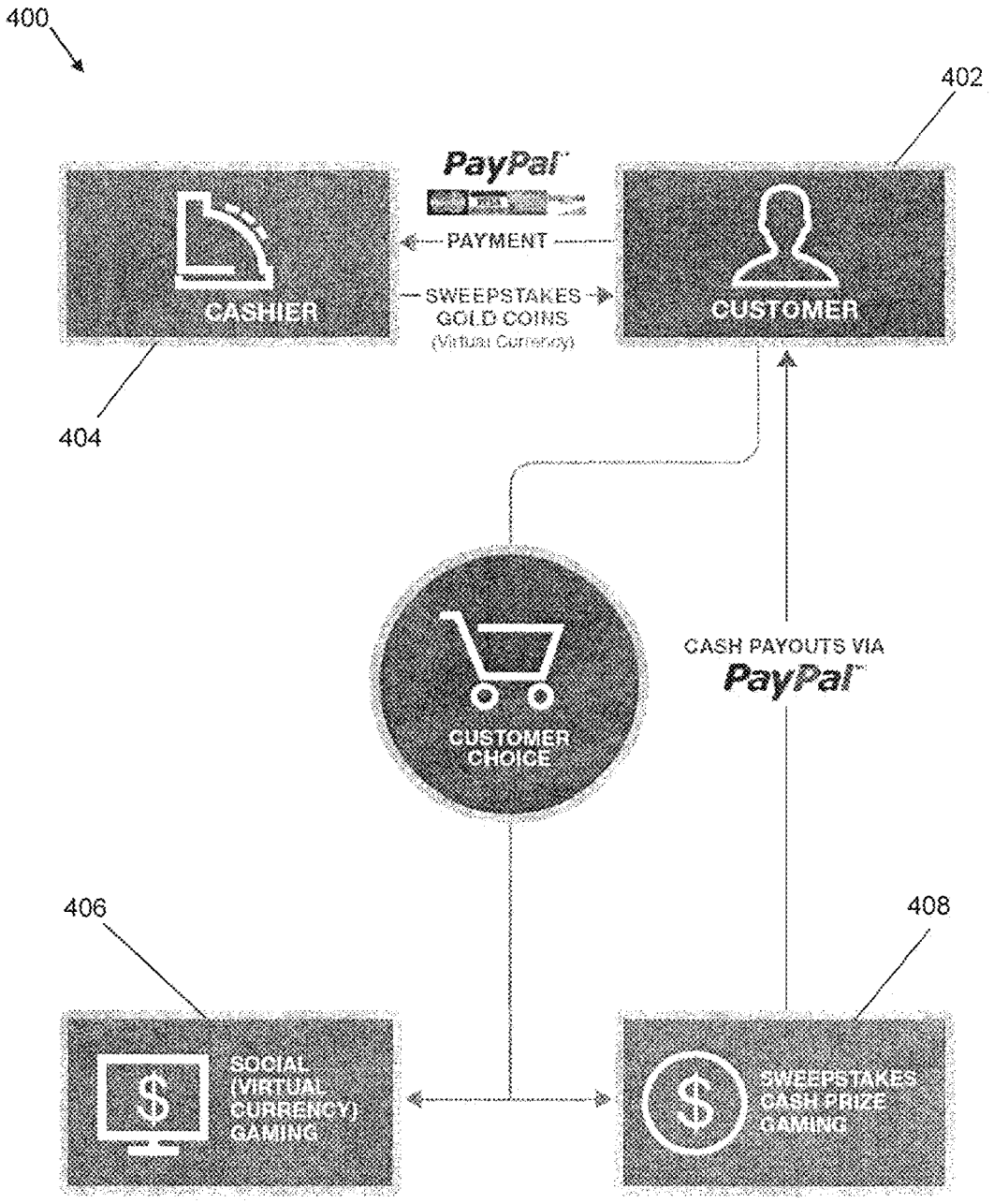
FIG. 4 is flow diagram illustrating an allocation to a player of a virtual gaming currency and non-monetary sweepstakes entries according to a representative embodiment of the present disclosure.

An exemplary system for acquisition of virtual gaming currency and non-monetary sweepstakes entries by a player is illustrated by the diagram 400 in FIG. 4. In this diagram 400, the customer or player 402 is able to purchase from an online cashier 404 an amount of virtual gaming currency for use on the gaining service. In exchange for payment from the player 402, via a suitable payment transaction platform (e.g., PayPal), the player 402 receives a requested quantity of virtual gaming currency (i.e., Gold Coins) 406 as well as a bonus quantity of non-monetary sweepstakes entries (e.g., Sweepstakes Credits) 408, which can be redeemed for cash by the player 402 during the gaming service.

At step 304, the method 300 provides a plurality of sweepstakes games, each of said sweepstakes games being open for entry to one or more eligible players each having at least one non-monetary sweepstakes entry (e.g., Sweepstakes Credit). As described above, and in an exemplary embodiment, the method 300 provides access to a virtual slot machine (accessible via a computing device on, for example, a social media platform such as Facebook or the like). The method 300 allows for participation in the gaming service on a non-monetary basis, through the use of either a virtual gaming currency (e.g., 'Gold Coins'), or non-monetary sweepstakes entries (e.g., Sweepstakes Credits). The operation of the virtual slot machine game provided to a player does not change based on the player's selection of either the virtual gaming currency (e.g., 'Gold Coins'), or non-monetary sweepstakes entries (e.g., Sweepstakes Credits).

At step 306 of the method 300, the player is provided, via a user device 106, with a graphical user interface being configured to allow the player to assign the at least one non-monetary sweepstakes entry to at least one sweepstakes game. An example of a graphical user interface provided to a player in accordance with step 306 of the method 300 is shown at FIGS. 5A and 5B, which illustrates an example of a virtual slot machine game shown on a graphical user interface 500 that provides a player with an option to use non-monetary sweepstakes entries (e.g., Sweepstakes Credits). The graphical user interface 500 provides the player with an option to use either the virtual gaming currency (e.g., Gold Coins), or non-monetary sweepstakes entries (e.g., Sweepstakes Credits). The player's current balance of virtual gaming currency (i.e., Gold Coins) is shown in the display 502 on the graphical user interface 500. The player is also provided with an option, via the button 504 to switch play to the use of non-monetary sweepstakes entries (e.g., Sweepstakes Credits). Once this option has been selected by the player, the gaining service essentially becomes one of providing sweepstakes games.

At step 308, the method 300 involves receiving from the player, via the communications network, an indication that at least one non-monetary sweepstakes entry (e.g., Sweepstakes Credits) has been assigned to the at least one sweepstakes game. Referring again to the graphical user interface 500 shown in FIG. 5A and the line drawing of the graphical user interface 550 shown in FIG. 5B of the drawings, once a player has selected the option to play with non-monetary sweepstakes entries (e.g., Sweepstakes Credits), by pressing button 504 on the graphical user interface 500, the gaming system (and specifically the computer server 104) receives an indication that the player has assigned at least one non-monetary sweepstakes entry (e.g. Sweepstakes Credit) to the sweepstakes game. While not specifically illustrated in the Figures, it should also be appreciated that a player may have the option to increase or decrease the number of non-monetary sweepstakes entries (e.g., Sweepstakes Credits) by utilizing additional functional gameplay features on the graphical user interface 500. For example, as shown on the graphical user interface 500, the user may select the control 510 to increase or decrease the number of non-monetary sweepstakes entries (e.g., Sweepstakes Credits) assigned to a particular sweepstakes game, alternatively, select the 'Max Bet' option 512 to assign the maximum number of non-monetary sweepstakes entries (e.g., Sweepstakes Credits) to a particular sweepstakes game. A sweepstakes game is effectively commenced when at least one player presses the 'SPIN' button 506 on the graphical user interface 500.

At step 310, the method 300 involves operating the at least one sweepstakes game. This step 310 firstly involves determining, at the server 104, a sweepstakes pool based on the total number of non-monetary sweepstakes entries (e.g., Sweepstakes Credits) assigned to the at least one sweepstakes game by the one or more eligible players. Once the total sweepstakes pool has been determined, the step 310 then involves randomly selecting one or more of the eligible players as the winner or winners of the sweepstakes game. Known techniques for randomly selecting the winner of the sweepstakes game are preferably employed such as, for example, the use of pseudo random number generators (PRNGs) to arrive at a winner or winners from the eligible players (in the case of the virtual slot machine game depicted in FIGS. 5A and 5B). Alternatively, in some embodiments the winner or winners of the sweepstakes game may be determined based on a particular outcome of a game or by a player winning a contest. It should be appreciated that step 310 of the method 300 may vary depending on the game to which the method is applied. For example, in the virtual slot machine game depicted in FIGS. 5A and 5B, the operation of the game involves no element of skill, and payouts are determined according to standard slot machine odds (depending on the specific implementation of the game).

At step 312, the method 300 involves awarding to the player, if the at least one sweepstakes game results in a successful outcome, an allocation of non-monetary sweepstakes entries (e.g., Sweepstakes Credits) representing the player's winnings (i.e., the payout received by the player) from the at least one sweepstakes game. Assuming that a player has been successful in a sweepstakes game at step 310 of the method 300, step 312 involves awarding to the player a 'payout,' representing the player's winnings from the sweepstakes game. The specific amount of the 'payout' to the player will depend on various factors such as, for example, the number of eligible players that participated in the sweepstakes game, the type of sweepstakes game (e.g., virtual slot machine), and/or the amount of non-monetary sweepstakes entries (e.g., Sweepstakes Credits) assigned by the player to the sweepstakes game. For example, if five non-monetary sweepstakes entries were assigned to a particular sweepstakes game, then based on a 1-to-1 return for a successful entry, the allocation of non-monetary sweepstakes entries representing the player's winnings would be ten non-monetary sweepstakes entries. However, it should be appreciated that alternate payout ratios are also envisioned by the present disclosure.

At step 314, the method 300 involves notifying the player (in the event of a successful outcome in the at least one sweepstakes game), via the graphical user interface 500, of the allocation of non-monetary sweepstakes entries (e.g., Sweepstakes Credits) representing the player's winnings from the at least one sweepstakes game. While not specifically illustrated in Figures SA and SB, the allocation of non-monetary sweepstakes entries (e.g., Sweepstakes Credits) representing the player's winnings or 'payout' from the sweepstakes game may be presented to the player in the display 514 on the graphical user interface 500. Once the 'payout' has been presented to the player, the allocation of non-monetary sweepstakes entries (e.g., Sweepstakes Credits) representing the player's winnings is added to the player's current balance of non-monetary sweepstakes entries (e.g., Sweepstakes Credits), and the total presented to the player in the display 502 on the graphical user interface 500 (note that the display 502 switches to display the balance of the player's non-monetary sweepstakes entries (e.g., Sweepstakes Credits) once the option 504 to use non-monetary sweepstakes entries (e.g., Sweepstakes Credits) has been selected.

In an exemplary embodiment of the present invention, the player's current balance of non-monetary sweepstakes entries (e.g., Sweepstakes Credits) is also displayed 520 on the graphical user interface 500 in terms of its redeemable cash value. For example, the player's current balance of non-monetary sweepstakes entries (e.g., Sweepstakes Credits) is converted to its redeemable cash value in US dollars, and displayed 520 to the player on the graphical user interface 500. Again, as previously described, the player may opt to redeem or exchange their current balance of non-monetary sweepstakes entries (e.g. Sweepstakes Credits) for a monetary reward (e.g. legally accepted monetary tender such as, for example, US dollars). This process is commenced when the player presses the 'Cash Out' button 522 on the graphical user interface. Once the button 522 is pressed, the computer server 104 receives a notification to commence a cash payment to the player's nominated transaction account (e.g. the player's nominated PayPal account that was provided to the system during the registration process).

Figure 6:
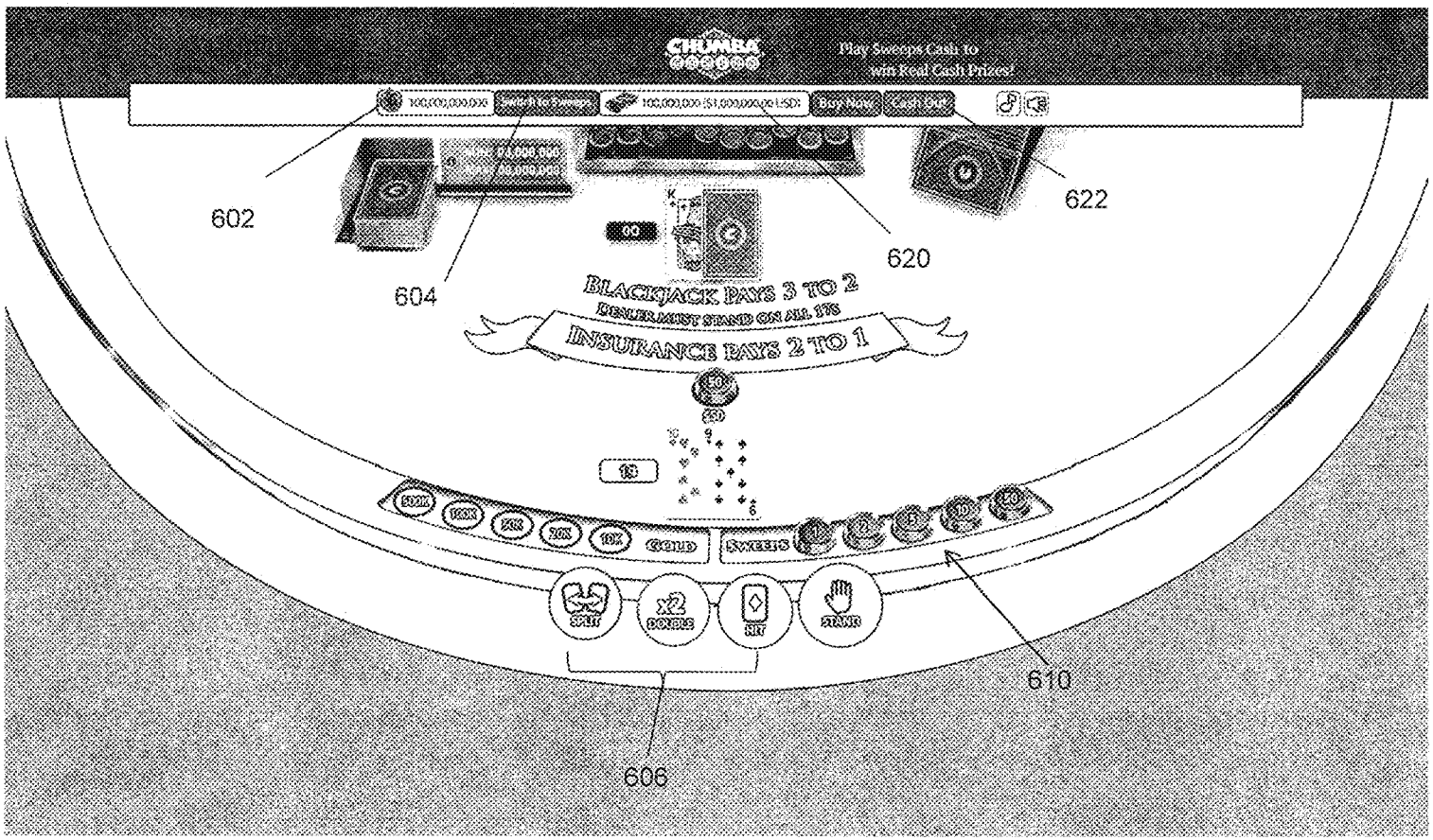
FIG. 6 is a line drawing of a graphical user interface presented to a player according to a further representative embodiment of the present invention.

In an alternate embodiment of the present invention, the method 300 can be equally applied to a game of Blackjack, such as depicted by the graphical user interface shown in FIG. 6. As with the previous embodiment 500 described, the graphical user interface 600 provides the player with an option to use either the virtual gaming currency (e.g. Gold Coins), or non-monetary sweepstakes entries (e.g., Sweepstakes Credits). The player's current balance of virtual gaming currency (i.e., Gold Coins) is shown in the display 602 on the graphical user interface 600. The player is also provided with an option, via the button 604 to switch play to the use of non-monetary sweepstakes entries (e.g., Sweepstakes Credits). Once this option has been selected by the player, the gaming service essentially becomes one of providing sweepstakes games.

Once a player has selected the option to play with non-monetary sweepstakes entries (e.g., Sweepstakes Credits), by pressing button 604 on the graphical user interface 600, the gaming system (and specifically the server 104) receives an indication that the player has assigned at least one non-monetary sweepstakes entry (e.g., Sweepstakes Credit) to the sweepstakes game. The specific amount of non-monetary sweepstakes entries (e.g., Sweepstakes Credits) assigned to the sweepstakes game can be modified by the player using buttons 610 corresponding to various amounts of non-monetary sweepstakes entries (e.g. Sweepstakes Credits). Once a player is satisfied with the amount of non-monetary sweepstakes entries (e.g., Sweepstakes Credits) assigned to a particular game, the game can proceed in accordance with the specific rules of the game (e.g., a Blackjack game), which includes the odds and methods for determination of payouts of non-monetary sweepstakes entries (e.g., Sweepstakes Credits) in the event of a winning game by a player. In accordance with the Blackjack game depicted in FIG. 6 of the drawings, the player may have options to 'play' the game by selecting from play buttons 606 that control the flow of cards dealt to the player.

The player's current balance of non-monetary sweepstakes entries (e.g., Sweepstakes Credits) is also displayed 620 on the graphical user interface 600 in terms of its redeemable cash value. Again, as previously described, the player may opt to redeem or exchange their current balance of non-monetary sweepstakes entries (e.g., Sweepstakes Credits) for a monetary reward (e.g., legally accepted monetary tender such as, for example, US dollars). This process is commenced when the player presses the 'Cash Out' button 622 on the graphical user interface. Once the button 622 is pressed, the server 104 receives a notification to commence a cash payment to the player's nominated transaction account (e.g. the player's nominated PayPal account that was provided to the system during the registration process).

Figure 7:
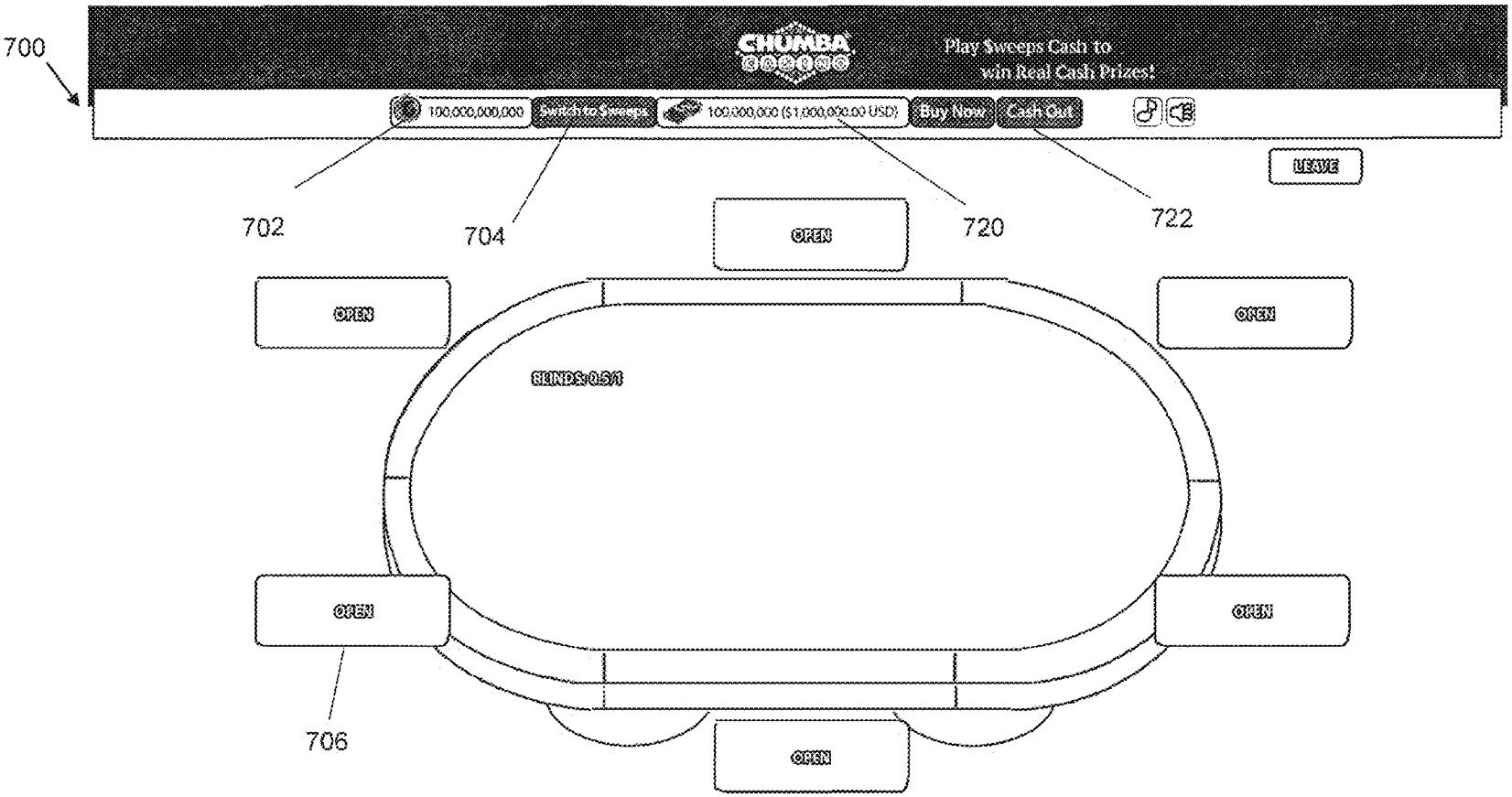
FIG. 7 is a line drawing of a graphical user interface presented to a player according to a still further representative embodiment of the present invention.

In an alternate embodiment of the present invention, the method 300 can be equally applied to a game of Poker, such as depicted by the graphical user interface shown in FIG. 7 of the drawings. As with the previous embodiment 500 described, the graphical user interface 700 provides the player with an option to use either the virtual gaming currency (e.g. Gold Coins), or non-monetary sweepstakes entries (e.g., Sweepstakes Credits). The player's current balance of virtual gaming currency (i.e., Gold Coins) is shown in the display 702 on the graphical user interface 600. The player is also provided with an option, via the button 704 to switch play to the use of non-monetary sweepstakes entries (e.g., Sweepstakes Credits). Once this option has been selected by the player, the gaming service essentially becomes one of providing sweepstakes games.

Once a player has selected the option to play with non-monetary sweepstakes entries (e.g., Sweepstakes Credits), by pressing button 604 on the graphical user interface 700, the gaming system (and specifically the computer server 104) receives an indication that the player has assigned at least one non-monetary sweepstakes entry (e.g., Sweepstakes Credit) to the sweepstakes game. The specific amount of non-monetary sweepstakes entries (e.g., Sweepstakes Credits) assigned to the sweepstakes game can be modified by the player (subject to the maximum and minimum betting limits applicable to that game of Poker). Once a player is satisfied with the amount of non-monetary sweepstakes entries (e.g., Sweepstakes Credits) assigned to a particular game, the game can proceed in accordance with the specific rules of the game (e.g., a Poker game), which includes the odds and methods for determination of payouts of non-monetary sweepstakes entries (e.g., Sweepstakes Credits) in the event of a winning game by a player or based on a particular outcome. In accordance with the Poker game depicted in FIG. 7 of the drawings, the player may have options to 'play' the game by operating one or more positions 706 on the Poker table and selecting the amount of cards to be dealt to those positions 706 (according to the specific rules of Poker relevant to that game).

The player's current balance of non-monetary sweepstakes entries (e.g., Sweepstakes Credits) is also displayed 720 on the graphical user interface 600 in terms of its redeemable cash value. Again, as previously described, the player may opt to redeem or exchange their current balance of non-monetary sweepstakes entries (e.g., Sweepstakes Credits) for a monetary reward (e.g., legally accepted monetary tender such as, for example, US dollars). This process is commenced when the player presses the 'Cash Out' button 722 on the graphical user interface 600. Once the button 722 is pressed, the server 104 receives a notification to commence a cash payment to the player's nominated transaction account (e.g., the player's nominated PayPal account that was provided to the system during the registration process).

In an alternate embodiment of the present invention, the method 300 can be equally applied to sporting games such as, for example, the outcomes of actual sporting events (e.g., soccer, football, tennis, etc.) and/or the outcomes of digital fantasy sports (DFS) competitions that take into consideration the outcomes of actual sporting events. Such DFS competitions may include any sweepstakes sports betting games known and used in the market, including, for example, ESPN's Streak for the Cash; Sports Illustrated's Kizzang Sweepstake, and Berkshire Hathaway's $1 Billion March Madness Sweepstakes. According to this embodiment of the invention, and by way of example, non-monetary sweepstakes entries (e.g., Sweepstakes Credits) may be awarded to a player for entering a round or league of play of a Digital Fantasy Sports (DFS) competition. The specific amount of non-monetary sweepstakes entries (e.g., Sweepstakes Credits) assigned to the sweepstakes game can be modified by the player (subject to the maximum and minimum betting limits applicable to that game). Once a player is satisfied with the amount of non-monetary sweepstakes entries (e.g., Sweepstakes Credits) assigned to a particular game, the game can proceed according to the specific rules of the game (e.g., a round or league of a fantasy sports competition, and/or the outcome of a particular sporting event), which includes the odds and methods for determination of payouts of non-monetary sweepstakes entries (e.g., Sweepstakes Credits) in the event of a winning game by a player or based on a particular outcome.

Methods for operating digital fantasy sports (DFS) games will be known to those skilled in the art, DFS, as used herein, may include traditional fantasy sports games, in which, for example, players compete against others by building a team of professional athletes from a particular league or competition. Restrictions may be put on team building, including, for example, setting a salary cap. In a DFS game utilizing a salary cap, each professional athlete may be assigned a cap number, i.e., an amount of points or money required to add that athlete to a team. The salary cap is the total number of points or money that may not be exceeded when building a team by adding professional athletes to the team. In DFS games, players earn points based on the actual statistical performance of the athletes in real-world competitions. Daily fantasy sports are an accelerated variant of traditional DFS that are conducted over a shorter time period, rather than over an entire professional or collegiate sports season. Time periods for daily fantasy sports can be as short as a portion of a game, e.g., an inning of a baseball game, and may also be based on single athletic event or game or a number of athletic events or games. DFS, including daily fantasy sports, are often structured or set up as paid competitions and are referred to as a "contest." In a particular contest, winners may have an opportunity to earn a portion or share of a pre-determined pot funded by their entry fees, including, in some DFS, the entire pre-determined pot. In some DFS, a portion of player entry fee payments may go to the organizer or provider of the DFS.

In some embodiments, the operation of the sweepstakes games and the operation of the online games may be one and the same. In other words, the sweepstakes game and the online game may be identical in terms of game play. The difference is that participation in the sweepstakes game requires an assignment of a non-monetary sweepstakes entry, whereas participation in the online game requires assignment of an alternate entry such as, for example, an allocation of the virtual gaming currency.

As the present invention may be embodied in several forms without departing from the essential characteristics of the invention, it should be understood that the above described embodiments should not be considered to limit the present invention but rather should be construed broadly.

Various modifications, improvements and equivalent arrangements will be readily apparent to those skilled in the art, and are intended to be included within the spirit and scope of the invention. The present embodiments are, therefore, to be considered in all respects as illustrative and not restrictive.

What is claimed is:

1. A computer-implemented method of providing gaming services, the method comprising:

at a first electronic device comprising one or more processor, a memory, and one or more programs stored in the memory and configured to be executed by the one or more processors:

receiving, via a communications network, a request for a quantity of virtual gaming tokens, wherein the request is associated with a player;

in response to receiving the request, causing an allocation of the requested quantity of virtual gaming tokens and one or more non-monetary sweepstakes entries to the player, wherein virtual gaming tokens cannot be redeemed for a monetary reward, and wherein winnings from playing with non-monetary sweepstakes entries can be redeemed for a monetary reward;

causing, via a communications network, a second electronic device to display a graphical user interface corresponding to a game having at least one successful outcome, wherein the graphical user interface comprises a user affordance for selecting one of playing the game with one or more virtual gaming tokens and playing the game with one or more non-monetary sweepstakes entries, and wherein the game is configured to be open for entry to one or more eligible players;

receiving from the second electronic device, via the communications network, an indication that at least one non-monetary sweepstakes entry has been assigned to the game by a player;

after receiving the indication from the second electronic device, causing, using at least in part the processor and the memory of the first electronic device, the game to be played to obtain an outcome;

determining an allocation of non-monetary sweepstakes entries representing the player's winnings based on the outcome of the game to the player; and causing the second electronic device to display an indication of the allocation of non-monetary sweepstakes entries.

2. The computer-implemented method according to claim 1, further comprising:

allowing the player to accumulate the allocated non-monetary sweepstakes entries for use in subsequent games.

3. The computer-implemented method according to claim 1, further comprising:

allowing the player to redeem the allocated non-monetary sweepstakes entries for a monetary reward.

4. The computer-implemented method according to claim 1, further comprising:

after receiving the request, calculating, based on the quantity of the virtual gaming tokens requested, an amount of non-monetary sweepstakes entries to be allocated to the player; and allocating to the player, via the communications network, the requested quantity of virtual gaming tokens and the calculated amount of non-monetary sweepstakes entries.

5. The computer-implemented method according to claim 1, further comprising:

receiving from the player a request to receive a quantity of non-monetary sweepstakes entries for free; and allocating to the player, via the communications network, the quantity of non-monetary sweepstakes entries.

6. The computer-implemented method according to claim 1, further comprising:

determining a sweepstakes pool based on a total number of non-monetary sweepstakes entries assigned to the game by the one or more eligible players; and randomly selecting one or more of the eligible players as a winner or winners of the game.

7. The computer-implemented method according to claim 1, wherein the allocation of non-monetary sweepstakes entries is based on a quantity of non-monetary sweepstakes entries assigned by the player to the game.

8. A system of providing gaming services, the system comprising:

a computer server accessible through a communications network, the computer server arranged to receive gaming data through the communications network; and a processor communicatively coupled to the computer server, wherein the processor is configured to:

receive, via a communications network, a request for a quantity of virtual gaming tokens, wherein the request is associated with a player;

in response to receiving the request, cause an allocation of the requested quantity of virtual gaming tokens and one or more non-monetary sweepstakes entries to the player, wherein virtual gaming tokens cannot be redeemed for a monetary reward, and wherein winnings from playing with non-monetary sweepstakes entries can be redeemed for a monetary reward;

cause, via the communications network, a second electronic device to display a graphical user interface corresponding to a game having at least one successful outcome, wherein the graphical user interface comprises a user affordance for selecting one of playing the game with one or more virtual gaming tokens and playing the game with one or more non-monetary sweepstakes entries, and wherein the game is configured to be open for entry to one or more eligible players;

receive from the second electronic device, via the communications network, an indication that at least one non-monetary sweepstakes entry has been assigned to the game by a player;

after receiving the indication from the second electronic device, cause, using at least in part the processor and the memory of the computer server, the game to be played to obtain an outcome;

determine an allocation of non-monetary sweepstakes entries representing the player's winnings based on the outcome of the game to the player; and cause the second electronic device to display an indication of the allocation of nonmonetary sweepstakes entries.

9. The system according to claim 8, wherein the processor is further configured to:

allow the player to accumulate the allocated non-monetary sweepstakes entries for use in subsequent sweepstakes games.

10. The system according to claim 8, wherein the processor is further configured to:

allow the player to redeem the allocated non-monetary sweepstakes entries for a monetary reward.

11. The system according to claim 8, wherein the processor is further configured to:

after receiving the request, calculate, based on the quantity of the virtual gaming tokens requested, an amount of nonmonetary sweepstakes entries to be allocated to the player; and allocate to the player, via the communications network the requested quantity of virtual gaming tokens and the calculated amount of non-monetary sweepstakes entries.

12. The system according to claim 8, wherein the processor is further configured to:

receive from the player a request to receive a quantity of non-monetary sweepstakes entries for free; and allocate to the player, via the communications network, the quantity of non-monetary sweepstakes entries.

13. The system according to claim 8, wherein the processor is further configured to:

determine a sweepstakes pool based on a total number of non-monetary sweepstakes entries assigned to the game by the one or more eligible players; and randomly select one or more of the eligible players as a winner or winners of the game.

14. The system according to claim 8, wherein the allocation of non-monetary sweepstakes entries is based on a quantity of non-monetary sweepstakes entries assigned by the player to the game.

15. A non-transient computer-readable medium storing one or more programs, the one or more programs including instructions, which when executed by one or more processors of an electronic device, causes the electronic device to receive, via a communications network, a request for a quantity of virtual gaming tokens, wherein the request is associated with a player;

in response to receiving the request, cause an allocation of the requested quantity of virtual gaming tokens and one or more non-monetary sweepstakes entries to the player, wherein virtual gaming tokens cannot be redeemed for a monetary reward, and wherein winnings from playing with non-monetary sweepstakes entries can be redeemed for a monetary reward;

cause, via a communications network, a second electronic device to display a graphical user interface corresponding to a game configured to be open for entry to one or more eligible players, wherein the graphical user interface comprises a user affordance for selecting one of playing the game with one or more virtual gaming tokens and playing the game with one or more non-monetary sweepstakes entries;

receive from the second electronic device, via the communications network, an indication that at least one non-monetary sweepstakes entry has been assigned to the game by a player;

after receiving the indication from the second electronic device, cause, using at least in part the computer-readable medium and the one or more processors, the game to be played to obtain an outcome;

determine an allocation of non-monetary sweepstakes entries representing the player's winnings based on the outcome of the game to the player; and cause the second electronic device to display an indication of the allocation of non-monetary sweepstakes entries.

* * * * *